US007100770B2

(12) United States Patent
D'Amato

(10) Patent No.: US 7,100,770 B2
(45) Date of Patent: Sep. 5, 2006

(54) CARDBOARD CONTAINER FOR DRINKS AND PROCESS THEREFOR

(75) Inventor: Gianfranco D'Amato, Arzano (IT)

(73) Assignee: Seda S.p.A., Arzano (IT)

( * ) Notice: Subject to any disclaimer, the term of this patent is extended or adjusted under 35 U.S.C. 154(b) by 40 days.

(21) Appl. No.: 10/470,431

(22) PCT Filed: Jan. 15, 2002

(86) PCT No.: PCT/EP02/00346

§ 371 (c)(1),
(2), (4) Date: Dec. 30, 2003

(87) PCT Pub. No.: WO02/060767

PCT Pub. Date: Aug. 8, 2002

(65) Prior Publication Data

US 2004/0094612 A1 May 20, 2004

(30) Foreign Application Priority Data

Jan. 30, 2001 (EP) ..... 01830056

(51) Int. Cl.
*B65D 3/22* (2006.01)
*B65D 21/04* (2006.01)
*B31B 1/28* (2006.01)

(52) U.S. Cl. ..... 206/505; 206/515; 206/519; 206/520; 229/403; 493/58; 493/111; 493/112; 493/114; 493/152; 493/159

(58) Field of Classification Search ..... 229/400, 229/403; 206/505, 506, 515, 518, 519, 520; 493/58, 111, 112, 114, 152, 154, 155, 158, 493/159

See application file for complete search history.

(56) References Cited

U.S. PATENT DOCUMENTS

| | | | | |
|---|---|---|---|---|
| 1,756,243 | A * | 4/1930 | Benson | 493/155 |
| 2,563,352 | A * | 8/1951 | Morse | 206/515 |
| 3,208,631 | A * | 9/1965 | Edwards | 206/519 |
| 3,526,316 | A * | 9/1970 | Kalogris | 229/400 |
| 3,612,346 | A * | 10/1971 | Schneider | 206/519 |
| 4,049,122 | A * | 9/1977 | Maxwell | 206/519 |
| 4,102,454 | A * | 7/1978 | Karevaara | 206/519 |
| 4,129,065 | A * | 12/1978 | Corse | 493/396 |
| 4,231,476 | A * | 11/1980 | Compton et al. | 206/519 |
| 4,936,448 | A * | 6/1990 | Holloway | 206/519 |
| 5,226,585 | A * | 7/1993 | Varano | 229/403 |
| 5,425,497 | A * | 6/1995 | Sorensen | 229/403 |
| 5,489,063 | A * | 2/1996 | Buchalski et al. | 206/520 |
| 5,542,599 | A | 8/1996 | Sobol | |
| 6,193,098 | B1 * | 2/2001 | Mochizuki et al. | 229/403 |

FOREIGN PATENT DOCUMENTS

| | | |
|---|---|---|
| DE | 42 26 313 | 2/1994 |
| EP | 1 031 514 | 8/2000 |

* cited by examiner

*Primary Examiner*—Gary E. Elkins
(74) *Attorney, Agent, or Firm*—Young & Thompson

(57) ABSTRACT

A cardboard container for drinks and a process for making it is provided. The container has a perimetral wall (2) and a bottom wall and includes elements (4) for supporting another such container (1) nested inside.

2 Claims, 3 Drawing Sheets

CARDBOARD CONTAINER FOR DRINKS AND PROCESS THEREFOR

The present invention relates to a container for drinks and, more precisely, of a type having a laminated cardboard wall for allowing the gripping thereof when hot drinks be contained therein.

Several types of containers for hot drinks are already known, typically made in suitable materials like laminated cardboard, PET, foam polystyrene, which are stackable for the subsequent sale thereof.

The problem with the polystyrene, plastics, and also cardboard containers, ensues from the fact that those are prone to get stuck during the stacked storage thereof.

For the plastics or polystyrene containers, several solutions have been adopted which consist in obtaining thereon, during the mould forming thereof, projecting members apt to provide a support thereto during the stacking stage thereof, thus avoiding interference between the walls of a first container when it is stacked on a respective underlying second container.

In the instance of the laminated cardboard containers, it is provided that the container wall be made with two cardboard layers, sandwiched by a web apt to form an air gap. Thus, an insulating effect on the wall is attained. However, a problem of such-like containers lies, given the wall compliance and the geometric configuration thereof, in their marked proneness to get stuck when stackedly stored.

A container known from EP 10 31 514 A has an inwardly projecting, circumferential rib serving to keep the adjacent inner and outer walls of two nested containers at a distance.

A double-walled container known from U.S. Pat. No. 5,542,599 A has an inwardly protruding circumferential rib along the full extension of the inner container wall. Two nested containers become stuck due to intimate contact between the lower conical part of the outer wall of the inner container and the inner conical wall part of the outer container.

The intimate contact significantly hinders separation of the nested containers.

A double-walled nestable container known from GB 261 532 C has an inwardly extending circumferential shoulder at the inner container wall. The bottom wall of the inner container of two nested containers rests on the shoulder of the outer container. The double wall structure of the container extends into the double-walled container bottom. Two nested containers the inner container of which is seated on the shoulder of the outer container with the outer container wall of the inner container being in intimate contact with the inner wall of the outer container such that both containers easily get stuck within each other. This hinders and easy separation of the containers. The vertical nesting distance between the bottoms of the nested containers is relatively large since the bottom of the inner container cannot be moved past the shoulder of the outer container. This results in an undesirable top wall storage height of a plurality of nested containers and high transport costs.

Therefore, the object of the present invention is to overcome the abovementioned problems providing a cardboard container with laminated walls which be apt to be stacked and not be prone to get stuck onto another container when in the stacked condition.

Hence, according to the present invention a cardboard container for hot drinks, having a perimetral wall and a bottom wall, characterised in that it further comprises means for the supporting thereof when it is stackedly arranged in a respective container, is provided.

The container of the present invention will hereinafter be better illustrated by a detailed description of a preferred embodiment thereof, given by way of example and not for limitative purposes, making reference to the annexed drawings, wherein.

Figure 1:
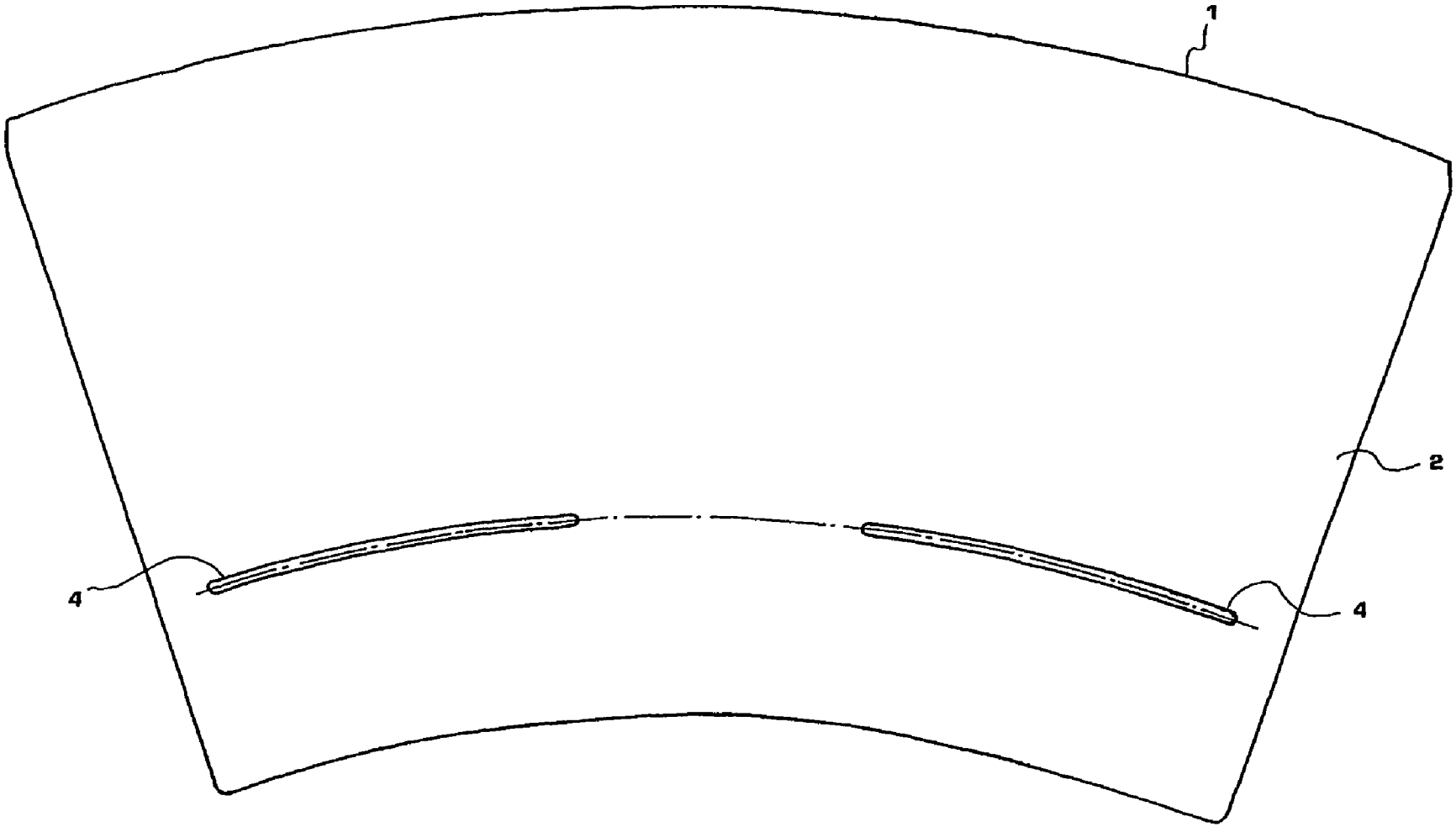
FIG. 1 is a plan view of a blank for the making of the container of the present invention.

With reference now to FIG. 1, a blank 1 apt to realise said container once assembled, having an outside surface 2 and an inside surface 3 (not shown in the FIG.) is illustrated. According to a first process of the present invention, it is provided that onto the surface 2 a creasing 4, apt to project internally to the container once assembled, be obtained (better illustrated hereinafter).

Figure 2:
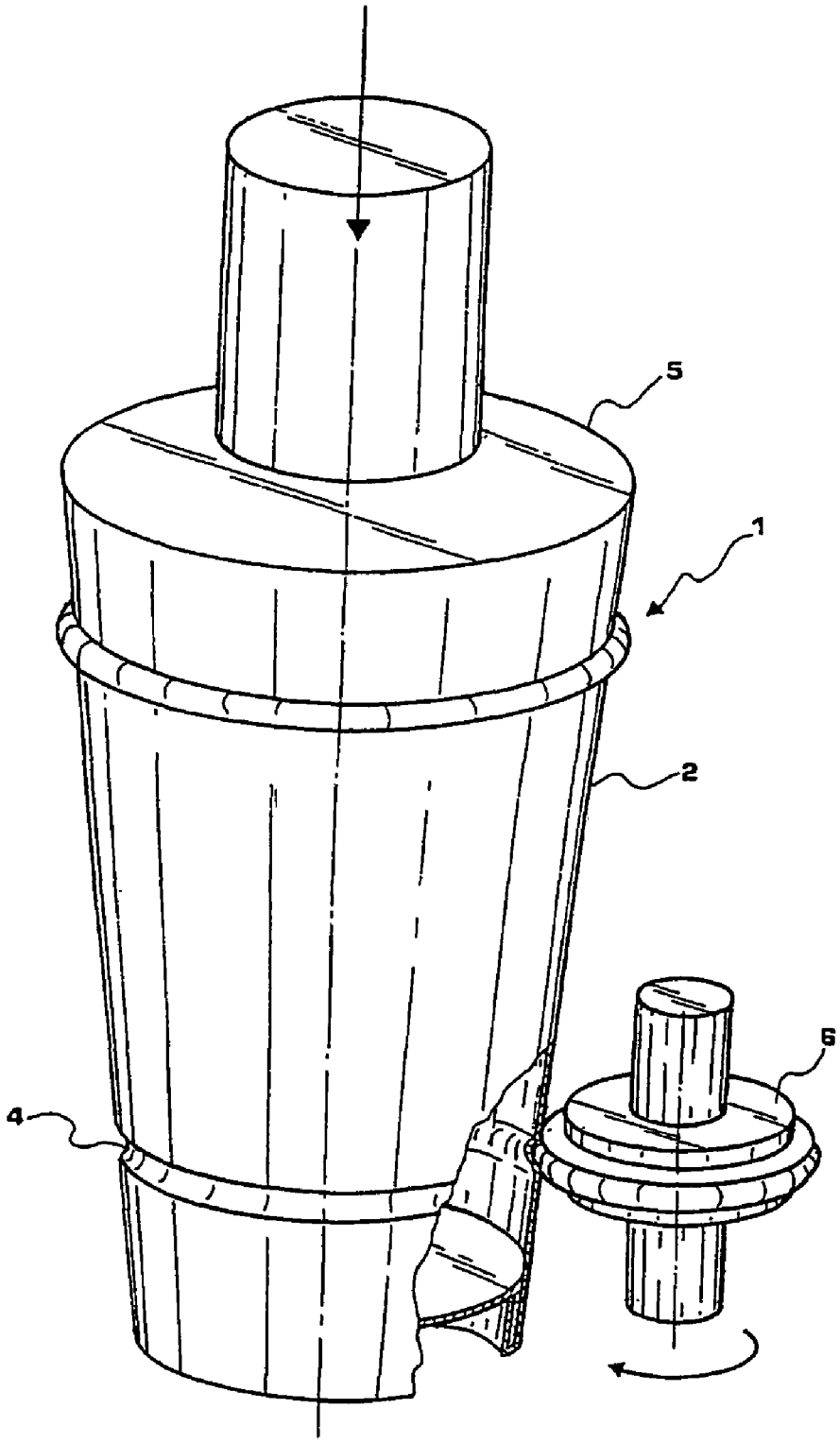
FIG. 2 is a schematic perspective view, partially illustrating a process for manufacturing the container of the present invention.

With reference to FIG. 2, an alternative process for manufacturing the container of the present invention is illustrated. For the sake of simplicity, same parts will be indicated by the same reference numbers.

According to such alternative process, it is provided that the container be formed with an uncreased blank 1, by arranging the former on a forming revolving supporting member 5. The revolving supporting member 5 has on its surface a perimetral groove apt to form a respective creasing 4 onto the outer surface 2 of the container 1 when the supporting member 5 revolvingly engages to a complementary knurl 6.

It has to be specified here that the complete apparatus and the related means for actuating the member 5 and the knurl 6 are not depicted in the Fig., as already comprised in the state of the art and, therefore, not forming part of the inventive scope of the present invention.

Figure 3:
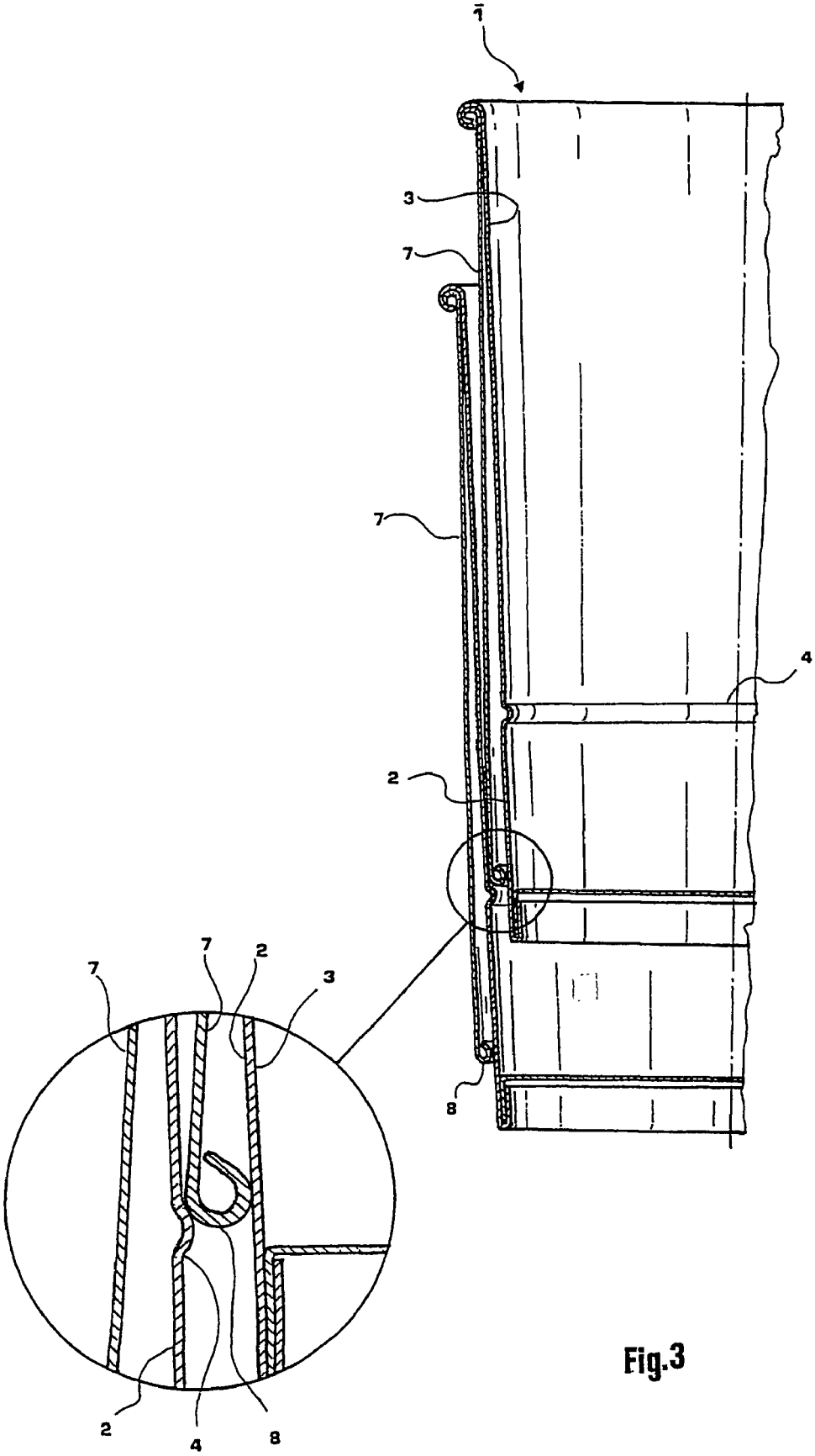
FIG. 3 is an elevational and partially sectional view illustrating the container of the present invention in a stacked condition.

Making now reference to FIG. 3, in a partial section an embodiment of the container 1 manufactured with the process of the present invention is illustrated. According to the present embodiment of the container, the latter is provided with a laminated wall wherein a second outside wall 7 fixedly arranged onto the container 1 with a respective forming step already known to the state of the art, is provided. This arrangement allows the manufacturing of a container 1 apt to provide an insulating effect onto the wall 7 and 2 by virtue of the presence of an air gap, hence being particularly suitable for hot drinks.

As it is apparent from the Fig., the forming of a creasing 4 allows a perfect stackability of a container 1 with respect to another identical one by virtue of the fact that the perimetral edge 8 of the second outside wall 7 is apt to rest onto the creasing 4 when the container 1 is inserted in another container 1. The arrangement of the creasing 4 allows to prevent a container 1, once inserted into another container 1, from getting stuck onto the outer walls of the latter. In fact, by virtue of the support provided by the creasing 4 to the outside wall 7, the container 1 is thus maintained in position without making the outside wall 7 thereof adhere onto the inside wall 3 of a respective underlying container 1, thus avoiding a stuck-up thereof.

It has to be pointed out that the present invention is also applicable to containers having an individual plain wall 2 wherein the contact is avoided by interference of the creasing 4 onto the outside wall 2 of a respective container 1 in the stacked condition.

The invention claimed is:

1. A nestable cardboard container (1), having a downwardly tapering conical inner wall (2) and a downwardly tapering conical outer wall (7), said walls being joined at the upper rim of the container, said outer wall (7) at its lower end resting against the outside surface of the inner wall (2) with an inwardly turned edge (8) so as to form an air gap between said walls, the inwardly turned edge (8) being located at a distance above the bottom rim of the container, the inner wall (2) having an inwardly protruding creasing (4) extending in the circumferential direction, said creasing being located above the bottom of the container thereby forming an abutment for the inwardly turned edge (8) of a nesting further container, the arrangement of the inwardly turned edge (8) and the inwardly extending creasing (4) being such that in the nested state the inner nested container is maintained in position in the outer container without making the outer wall (7) of the inner container adhere to the inside surface (3) of the inner wall (2) of the outer container.

2. A process for manufacturing a cardboard container (1), which comprises the following steps:

providing a blank (1), arranging said blank (1) on a revolving supporting member (5) having a perimetral groove and form an inner wall (2) of said cardboard container(1), forming a perimetral inwardly projecting creasing (4) distant from a bottom rim of said container inner wall (2) with a related complementary knurl (6) adapted to co-operate with said perimetral groove of said revolving supporting member (5), fixing an outer wall (7) on the outer side of said container inner wall (2) with an air gap formed between both walls (2, 7), the outer wall (7) having a lower inwardly turned edge (8) situated nearer to said inner wall bottom rim than said creasing (4);

wherein said inner wall (2) and outer wall (7) are downwardly tapering and conical, said walls being joined at the upper rim of the container, said outer wall (7) at its lower end resting against the outside surface of the inner wall (2) with said inwardly turned edge (8) so as to form said air gap between said walls, the inwardly turned edge (8) being located at a distance above the bottom rim of the container, said inwardly protruding creasing (4) extending in the circumferential direction, said creasing being located above the bottom of the container thereby forming an abutment for the inwardly turned edge (8) of a nesting further container, the arrangement of the inwardly turned edge (8) and the inwardly extending creasing (4) being such that in the nested state the inner nested container is maintained in position in the outer container without making the outer wall (7) of the inner container adhere to the inside surface (3) of the inner wall (2) of the outer container.

* * * * *